US010254022B2

(12) United States Patent
Citti et al.

(10) Patent No.: US 10,254,022 B2
(45) Date of Patent: Apr. 9, 2019

(54) CONDENSER WITH A REFRIGERANT SUPPLY FOR AN AIR-CONDITIONING CIRCUIT

(71) Applicant: Valeo Systemes Thermiques, Le Mesnil Saint Denis (FR)

(72) Inventors: Isabelle Citti, Rosnay (FR); Sébastien Jacope, Beaumont sur Vesle (FR); Gaël Durbecq, Reims (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 122 days.

(21) Appl. No.: 14/652,394

(22) PCT Filed: Dec. 12, 2013

(86) PCT No.: PCT/EP2013/076399
§ 371 (c)(1),
(2) Date: Jun. 15, 2015

(87) PCT Pub. No.: WO2014/095573
PCT Pub. Date: Jun. 26, 2014

(65) Prior Publication Data

US 2015/0323231 A1 Nov. 12, 2015

(30) Foreign Application Priority Data

Dec. 21, 2012 (FR) ..... 12 62711

(51) Int. Cl.
*F28F 13/18* (2006.01)
*F25B 39/00* (2006.01)
(Continued)

(52) U.S. Cl.
CPC ..... *F25B 39/00* (2013.01); *F25B 39/04* (2013.01); *F28D 9/005* (2013.01); *F28D 9/0093* (2013.01);
(Continued)

(58) Field of Classification Search
CPC .... F25B 39/00; F25B 39/04; F25B 2339/043; F25B 2339/044; F25B 2339/0443; F25B 2339/0446; F28D 9/005; F28D 9/0093
(Continued)

(56) References Cited

U.S. PATENT DOCUMENTS 6,578,371 B1 * 6/2003 Beasley ..... F25B 39/04 62/474
7,469,554 B2 * 12/2008 Martins ..... F25B 39/04 165/140
(Continued)

FOREIGN PATENT DOCUMENTS

DE 10 2010 026507 A1 1/2012
DE 10 2011 110963 A1 6/2012
(Continued)

OTHER PUBLICATIONS

International Search Report issued in PCT/EP2013/076399 dated Mar. 25, 2014 (2 pages).

*Primary Examiner* — Claire Rojohn, III
(74) *Attorney, Agent, or Firm* — Osha Liang LLP

(57) ABSTRACT

A condenser for an air conditioning circuit is disclosed. The condenser has a housing which is connected to a refrigerating fluid reserve by a flange having cylinder shaped tubes, the housing receiving a first heat exchange portion between the refrigerating fluid and a cooling liquid, the first portion being configured to convey the refrigerating fluid to the refrigerating fluid reserve, and a second heat exchange portion which produces a heat exchange complement between the refrigerating fluid and the cooling liquid at the outlet of the refrigerating fluid reserve.

16 Claims, 2 Drawing Sheets

(51) Int. Cl.
*F25B 39/04* (2006.01)
*F28D 9/00* (2006.01)
*F28B 1/02* (2006.01)

(52) U.S. Cl.
CPC ... *F25B 2339/043* (2013.01); *F25B 2339/044* (2013.01); *F25B 2339/0443* (2013.01); *F28B 1/02* (2013.01)

(58) Field of Classification Search
USPC ..... 165/166
See application file for complete search history.

(56) References Cited

U.S. PATENT DOCUMENTS 9,322,319 B2 * 4/2016 Kim ..... F01P 3/18
2002/0059806 A1 * 5/2002 Nobuta ..... F25B 39/04 62/509
2002/0124593 A1 * 9/2002 Yamazaki ..... B60H 1/3229 62/509
2003/0140652 A1 * 7/2003 Yamazaki ..... B60H 1/3229 62/509
2004/0226703 A1 * 11/2004 Blomgren ..... F28B 1/02 165/167
2005/0268645 A1 * 12/2005 Kent ..... F25B 39/04 62/509
2007/0125527 A1 * 6/2007 Flik ..... F02B 29/0412 165/140
2007/0267000 A1 * 11/2007 Raduenz ..... F28D 9/0056 123/568.12
2012/0060550 A1 * 3/2012 Mann ..... F25B 39/00 62/513
2012/0061052 A1 * 3/2012 Alessandrelli ..... F24D 11/004 165/67
2012/0137725 A1 * 6/2012 Kim ..... B60H 1/00342 62/509
2013/0146257 A1 * 6/2013 Kim ..... F25B 39/04 165/104.21
2013/0146265 A1 * 6/2013 Kim ..... F25B 39/04 165/166
2016/0003128 A1 * 1/2016 Berger ..... F02B 29/0443 165/145
2016/0161160 A1 * 6/2016 Hofmann ..... F25B 39/04 62/474
2016/0320141 A1 * 11/2016 Barfknecht ..... F28D 9/0093

FOREIGN PATENT DOCUMENTS

DE 102012217090 A1 * 3/2014 ..... F25B 39/04
FR 2 947 041 A1 12/2010
WO WO 2012094652 A2 * 7/2012 ..... F28D 9/0037

* cited by examiner

CONDENSER WITH A REFRIGERANT SUPPLY FOR AN AIR-CONDITIONING CIRCUIT

The invention relates to a condenser having a refrigerating fluid reserve for an air conditioning circuit, in particular for a motor vehicle.

In this field, condensers which are located at the front face of the vehicles have been known for a long time. They bring about a heat exchange between a refrigerating fluid which flows in the condenser and an incident air flow. They are sometimes accompanied by a reserve or bottle of refrigerating fluid and provided with a portion which allows sub-cooling of the refrigerating fluid to be carried out at the outlet of the reserve.

There are also known condensers comprising a first heat exchange unit for cooling the refrigerating fluid by means of a coolant liquid and a second heat exchange unit for the sub-cooling of the refrigerating fluid by the coolant liquid, a refrigerating fluid reserve being interposed between the heat exchange units. The units comprise stacked plates which define between them circulation plates of the refrigerating fluid, in such a manner that a refrigerating fluid plate is located between two cooling fluid plates. However, such a solution with two stacks of plates has a poor degree of integration.

In an attempt to provide some improvement, there has been proposed a condenser in which the refrigerating fluid reserve is integrated in the stack, being positioned transversely relative to the plates. However, such a reserve is not in the best of configurations for operation. This is because the axial height of the reserve, corresponding to the height of the stack, is limited by the number of plates used.

Therefore, there is a need for improving such condensers and the invention proposes in this regard a condenser for an air conditioning circuit, the condenser comprising a housing which is configured to be connected to a refrigerating fluid reserve, also known as a bottle, the housing receiving a first heat exchange portion between the refrigerating fluid and a cooling liquid, the first portion being configured to convey the refrigerating fluid to the refrigerating fluid reserve, and a second heat exchange portion which is configured to produce a heat exchange complement between the refrigerating fluid and the cooling liquid at the outlet of the reserve.

As a result, the refrigerating fluid reserve is not confined in the housing but instead can freely extend in terms of length, preferably over the length of the housing, being, for example, adjacent to a long side of the housing, in order to extend over a great length and with reduced spatial requirement. Furthermore, there are two heat exchange zones in the same assembly, which allows the number of components of the condenser to be limited.

The refrigerating fluid reserve is advantageously fixed to the housing, preferably by a flange comprising inlet and outlet tubes of the refrigerating fluid extending in or out, respectively.

The condenser advantageously comprises at least one cooling liquid circuit of the heat exchange portions, which may be common to the heat exchange portions or different for each of them.

The condenser advantageously comprises an assembly of stacked plates which define between them circulation plates of the refrigerating fluid and the cooling fluid in the heat exchange portions, in particular in such a manner that a refrigerating fluid plate is located between two cooling fluid plates, the assembly of stacked plates being configured to provide a circulation path of the refrigerating fluid allowing circulation in series of the refrigerating fluid in the housing, from the first heat exchange portion toward the fluid reserve, then from the reserve into the second heat exchange portion.

The assembly of stacked plates is advantageously configured to provide a circulation path of the cooling fluid extending in the heat exchange portions, preferably from the second heat exchange portion to the first heat exchange portion. In a variant, it may define two different paths, which are associated with the different circuits set out above, respectively.

In particular, the stack of plates is configured to define a barrier to the circulation of the refrigerating fluid between the first heat exchange portion and second heat exchange portion.

That being the case, each of the plates advantageously extends with continuity of material in the region of the first heat exchange portion and the second heat exchange portion.

A condenser plate which defines a circulation plate of the refrigerating fluid may thus comprise a raised portion in order to define the barrier to the circulation of the refrigerating fluid between the first heat exchange portion and second heat exchange portion.

The stack of plates advantageously comprises inlet and/or outlet collectors of the refrigerating fluid, communicating with the circulation plates of the refrigerating fluid in the region of the first heat exchange portion and/or second heat exchange portion, and/or inlet and/or outlet collectors of the cooling liquid, communicating with the circulation plates of the cooling liquid.

The inlet and/or outlet collectors of the refrigerating fluid and the inlet and/or outlet collectors of the cooling liquid advantageously open at one side of the housing and/or at an opposite side, which is intended to be opposite the reserve.

The inlet collectors of the refrigerating fluid in the first exchange portion and outlet collectors of the refrigerating fluid of the second exchange portion, on the one hand, and the inlet collectors of the refrigerating fluid in the second exchange portion and outlet collectors of the refrigerating fluid of the first exchange portion, on the other hand, advantageously open at opposite sides of the housing.

According to other embodiments of the invention, which may be taken together or separately:

- the collectors open from the housing via openings and/or fluid inlet and/or outlet flanges;
- the inlet collector of refrigerating fluid in the first exchange portion is located opposite the inlet opening of the refrigerating fluid in the housing and the outlet collector of the refrigerating fluid of the first exchange portion is located opposite the inlet opening of the refrigerating fluid in the reserve;
- the first heat exchange portion extends in the housing between the inlet collector of the refrigerating fluid in the first exchange portion and the outlet collector of the refrigerating fluid of the first exchange portion;
- the inlet collector of refrigerating fluid in the second exchange portion is arranged opposite the outlet opening of the refrigerating fluid of the reserve, and the outlet collector of the refrigerating fluid of the second exchange portion is arranged opposite the outlet opening of the refrigerating fluid of the housing;
- the second heat exchange portion extends between the inlet collector of the refrigerating fluid in the second exchange portion and the outlet collector of the refrigerating fluid of the second heat exchange portion;
- the inlet collector of refrigerating fluid in the first exchange portion and outlet collector of the refrigerating fluid of the second exchange portion open near two opposite sides of the housing;

the inlet and outlet collectors of the cooling liquid advantageously open near the same opposite sides;

the assembly of stacked plates extends in a rectangular parallelepipedal volume, corresponding, for example, to that of the housing;

the inlet and outlet collectors of the cooling liquid and the inlet collectors of the refrigerating fluid in the first exchange portion and outlet collectors of the refrigerating fluid of the second exchange portion are orientated parallel along four of the edges of the housing;

the circulation plates of the refrigerating liquid and the circulation plates of the cooling liquid have different cross-sections;

the first heat exchange portion comprises partitions which are parallel with the plates and which are arranged alternately in the inlet collector of the refrigerating fluid and the outlet collector of the refrigerating fluid, so as to direct the refrigerating fluid in the first heat exchange portion in accordance with a plurality of circulation passes of the fluid, for example, with inversion of the direction of circulation of the fluid from one pass to another.

The invention also relates to a condenser plate as described above and the assembly of such a condenser and the corresponding reserve.

These features and others of the present invention are illustrated below with reference to the appended drawings, in which.

In the following description, identical reference numerals are used in order to refer to identical or similar elements.

As illustrated in FIGS. 1 to 4, the invention relates to a condenser 1 having a refrigerating fluid reserve 3 or bottle for an air conditioning circuit which is not illustrated, in particular an air conditioning circuit for a motor vehicle. The refrigerating fluid is, for example, the fluid known under the name of R134a, or the like. That condenser 1 comprises a housing 5, preferably a rectangular parallelepipedal housing as in the present case, configured to be connected to the refrigerating fluid reserve 3, which may be mounted so as to be remote from the housing 5 or fixed adjacent to the housing 5, as in the present case.

The reserve 3 is located in this instance opposite a lateral side 11' of the housing, that is to say, a side of the housing located between longitudinal end sides 12, 14 of the housing. Thus, it may extend over a great length and with a reduced spatial volume of the condenser.

Figures 1, 2, 3, 4, 5:
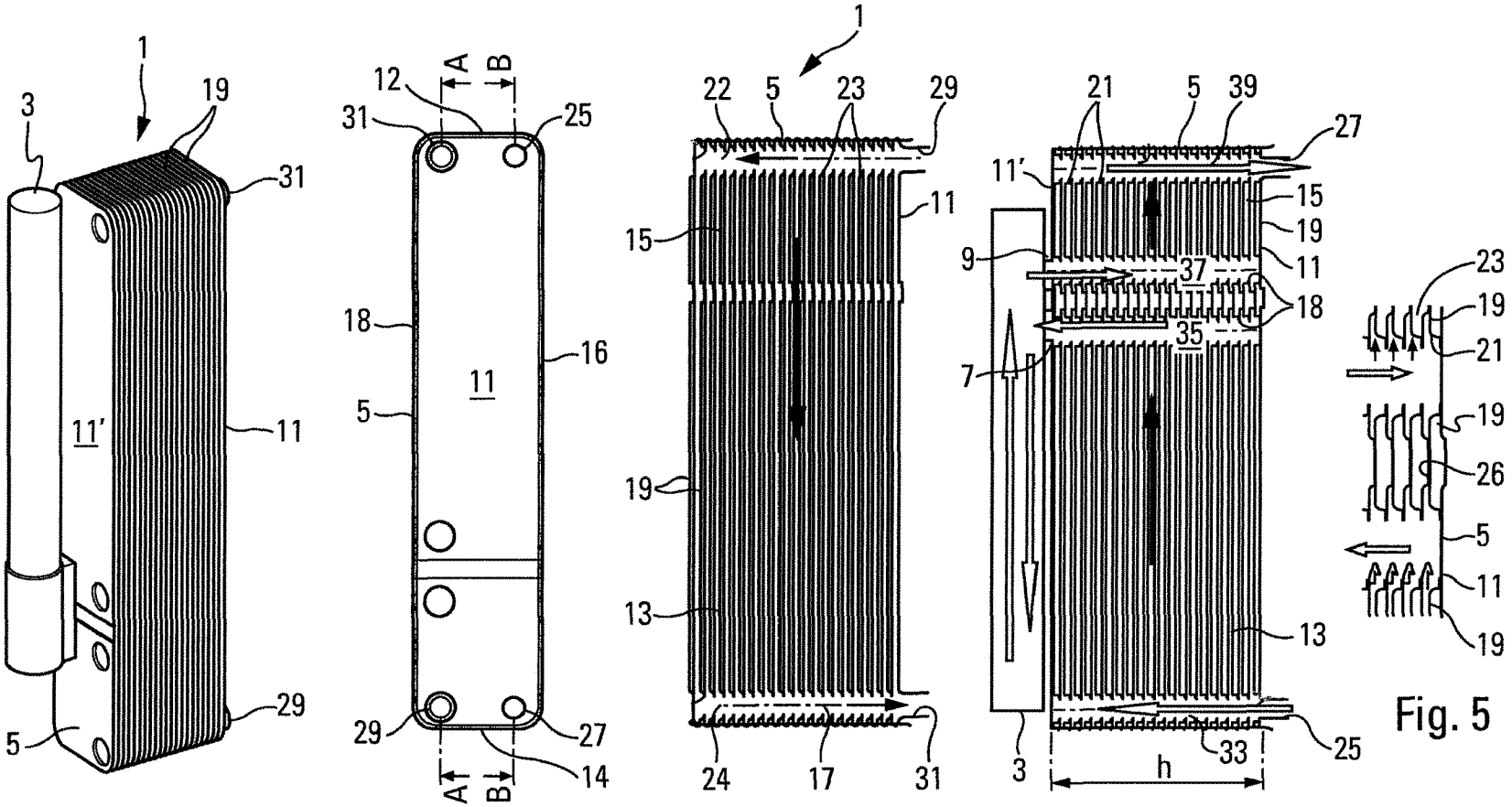
FIG. 1 is a perspective view of an embodiment of a condenser according to the invention.
FIG. 2 is a bottom view of that condenser.
FIG. 3 is a schematic cross-section of the condenser in accordance with the line B-B of FIG. 2.
FIG. 4 is a schematic cross-section of the condenser in accordance with the line A-A of FIG. 2.
FIG. 5 is an enlarged partial view of inlet and outlet collectors of the condenser of FIG. 4.

As may be seen in FIGS. 1 and 4, the refrigerating fluid reserve 3 is fixed to the housing 5 by a flange comprising two tubes 7, 9, an inlet and outlet tube of the refrigerating fluid in or out of that reserve, respectively.

The housing 5 receives a first heat exchange portion 13, which is intended in this instance to ensure the condensation of the refrigerating fluid by a heat exchange with a cooling liquid, and a second heat exchange portion 15 in order to produce in this instance a sub-cooling of the refrigerating fluid by the cooling liquid, at the outlet from the reserve 3. In this manner, the two heat exchange portions are integrated in one and the same structural unit.

Figure 7:
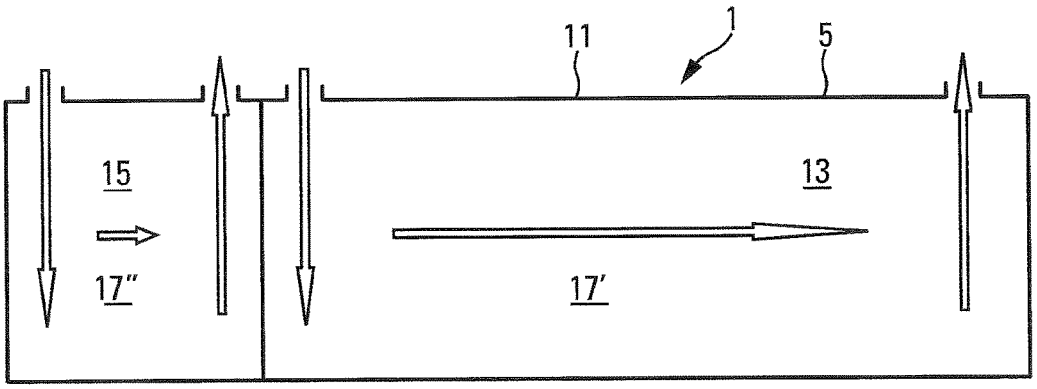
FIG. 7 is a schematic view of a path of cooling fluid of the condenser according to a construction variant.

The cooling liquid flows in a cooling liquid circuit 17 of the heat exchange portions 13, 15, which circuit may be common to the heat exchange portions, as illustrated in FIG. 3, or different for each of them, as illustrated in FIG. 7. The cooling liquid is, for example, glycol water.

With reference to FIGS. 3 to 5, the condenser 1 comprises an assembly of plates 19 which are stacked in accordance with a stacking direction, here substantially orthogonal to the plates. Advantageously, those plates extend with continuity of material over the first and second heat exchange portions 13 and 15. The plates define between them refrigerating fluid circulation plates 21 in the heat exchange portions, in such a manner that a refrigerating fluid plate 21 (FIG. 4) is located between two cooling fluid plates 23 of the cooling liquid circuit 17 (FIG. 3). The circulation plates have in this instance different heights.

The plates are constituted by a metal sheet, in particular of aluminum and/or aluminum alloy. They are formed, for example, by stamping. They may be assembled with each other by soldering in the region of a peripheral raised edge.

The assembly of stacked plates 19 constitutes in this instance the housing 5, which may further be formed in order to receive the assembly of stacked plates 19.

The assembly of stacked plates 19 is configured to provide a circulation path of the refrigerating fluid allowing circulation in series of the refrigerating fluid in the housing 5, from the first heat exchange portion 13 toward the fluid reserve 3, then from that reserve into the second heat exchange portion 15, as illustrated in FIG. 4 in accordance with the arrows.

The refrigerating fluid condensed in the first heat exchange portion 13 is thus conveyed to the refrigerating fluid reserve 3, which brings about a separation of gas/liquid phases of the refrigerating fluid and/or produces a filtration and/or a dehydration thereof.

The assembly of stacked plates 19 is further configured to provide the circulation path 17 of the cooling fluid extending in the heat exchange portions 13, 15, more specifically from the second heat exchange portion 15 to the first heat exchange portion 13, as illustrated in FIG. 3 in accordance with the arrows in order to bring about counter-current cooling.

The stack of plates 19 comprises inlet collectors 33, 37 and/or outlet collectors 35, 39 of the refrigerating fluid, communicating with the circulation plates of the refrigerating fluid in the region of the first and/or second heat exchange portion. It further comprises inlet collectors 22 and/or outlet collectors 24 of the cooling liquid, communicating with the circulation plates of the cooling liquid.

The collectors 22, 24, 33, 35, 37, 39 open either in the region of the lateral side 11' of the housing located opposite the reserve 3, or in the region of the opposite lateral side 11, that is to say, in the region of the lateral sides of the housing orientated perpendicularly to the stacking direction of the plates. This is because the collectors 22, 24, 33, 35, 37, 39 advantageously extend parallel with each other and parallel with the stacking direction.

In this instance, the inlet collectors 33 of the refrigerating fluid in the first exchange portion 13 and outlet collectors 39 of the refrigerating fluid of the second exchange portion 15, on the one hand, and the inlet collectors 37 of the refrigerating fluid in the second exchange portion 15 and outlet collectors 35 of the refrigerating fluid of the first exchange portion 13, on the other hand, open in an opposing manner in the region of the lateral sides 11, 11' perpendicular to the stacking direction. It is possible to note how such a characteristic allows the reserve 3 to extend in terms of length as far as a position directly below the inlet collector 33 of the refrigerating fluid in the first exchange portion.

The inlet collectors 22 and outlet collectors 24 of the cooling liquid open in this instance at the lateral side 11 opposite the side 11' which is located opposite the reserve 3.

The inlet collectors 22 and outlet collectors 24 of the cooling liquid, inlet collectors 33 of the refrigerating fluid in the first heat exchange portion and outlet collectors 39 of the refrigerating fluid of the second heat exchange portion open in openings of the housing, which are formed here as inlet tubes 29 and outlet tubes 31 of the cooling liquid and inlet tubes 25 and outlet tubes 27 of the refrigerating fluid. The other collectors 35 and 37 open at the tubes 7 and 9 of the reserve.

The inlet collectors 33 of the refrigerating fluid in the first exchange portion and outlet collectors 39 of the refrigerating fluid of the second exchange portion open near the two longitudinal end sides 12, 14 of the housing. Similarly, the inlet collectors 22 and outlet collectors 24 of the cooling liquid open near the opposite longitudinal end sides 12, 14 of the housing.

In the parallelepipedal configuration illustrated, the inlet collectors 22 and outlet collectors 24 of the cooling liquid and the inlet collectors 33 of the refrigerating fluid in the first exchange portion and outlet collectors 39 of the refrigerating fluid of the second exchange portion may advantageously be orientated parallel along four of the edges of the housing. In this manner, the inlet and outlet tubes 22, 24, 25, 27 are advantageously arranged in the region of the four corners at the lateral side 11 opposite the lateral side 11' located opposite the bottle. By the collectors 22, 24, 33, 39 being positioned in the region of opposing sides of the housing, the refrigerating fluid and the cooling liquid flow over a maximum extent.

The inlet collector 33 of refrigerating fluid in the first exchange portion is located opposite the inlet tube 25 of the refrigerating fluid in the housing and the outlet collector 35 of the refrigerating fluid of the first exchange portion is located opposite the inlet opening of the refrigerating fluid in the reserve 3, communicating in this instance with a first tube 7 of the tubes of the flange for securing the reserve to the housing. The first heat exchange portion extends in the housing between the inlet collector 33 of the refrigerating fluid in the first exchange portion and the outlet collector 35 of the refrigerating fluid of the first exchange portion.

The inlet collector 37 of refrigerating fluid in the second exchange portion is arranged opposite the outlet opening of the refrigerating fluid of the reserve 3, communicating here with a second tube 9 of the tubes of the flange for securing the reserve to the housing, and the outlet collector 39 of the refrigerating fluid of the second exchange portion is arranged opposite the outlet tube 27 of the refrigerating fluid of the housing. The second heat exchange portion extends between the inlet collector 37 of the refrigerating fluid in the second exchange portion and the outlet collector 39 of the refrigerating fluid of the second heat exchange portion.

That being the case, the stack of plates 19 is configured to define a barrier to the circulation of the refrigerating fluid between the first heat exchange portion 13 and second heat exchange portion 15.

As can be seen more clearly in FIG. 5, the plates 19, referred to as first plates, which define the circulation plates of the refrigerating fluid have a raised portion 26 defining the barrier. The height of the raised portion corresponds to the height of the refrigerating fluid plates. The raised edge extends over the width of the first plates, that is to say, in this instance, from one of the lateral sides 16 of the housing connecting the lateral sides 11, 11' perpendicular to the stacking direction to the opposite lateral side 18.

The first plates 19 have near the ends of one of the longitudinal sides thereof, on the one hand, a first hole for the inlet collector 33 of the refrigerating fluid in the first exchange portion and, on the other hand, a second hole for the outlet collector 39 of the refrigerating fluid of the second exchange portion. It further has, at one side and the other of the raised portion 26, a third hole for the outlet collector 35 of the refrigerating fluid of the first exchange portion and a fourth hole for the inlet collector 37 of the refrigerating fluid in the second exchange portion. Near the ends of the opposite longitudinal side thereof, it has a collar which has a height identical to that of the raised portion 26 and which is provided with a hole in order to allow communication between the cooling liquid plates which are located at one side and the other of the refrigerating fluid plate under consideration.

The other plates of the stack, referred to as second plates, are used to define the cooling liquid plates. They are provided with holes and collars which allow, in conjunction with the collars and the holes of the first plates, the collectors 22, 24, 33, 35, 37, 39 to be defined.

Construction variants will now be described.

As indicated above, the heat exchange portions 13, 15 may comprise different cooling liquid circuits 17', 17", respectively, as illustrated in FIG. 7, the arrows representing the direction of flow of the cooling liquid of each of those circuits 17', 17" of the cooling liquid. Thus, the second plates may or may not be provided with a raised portion forming a barrier, in accordance with the number of cooling circuits desired.

Figure 6:
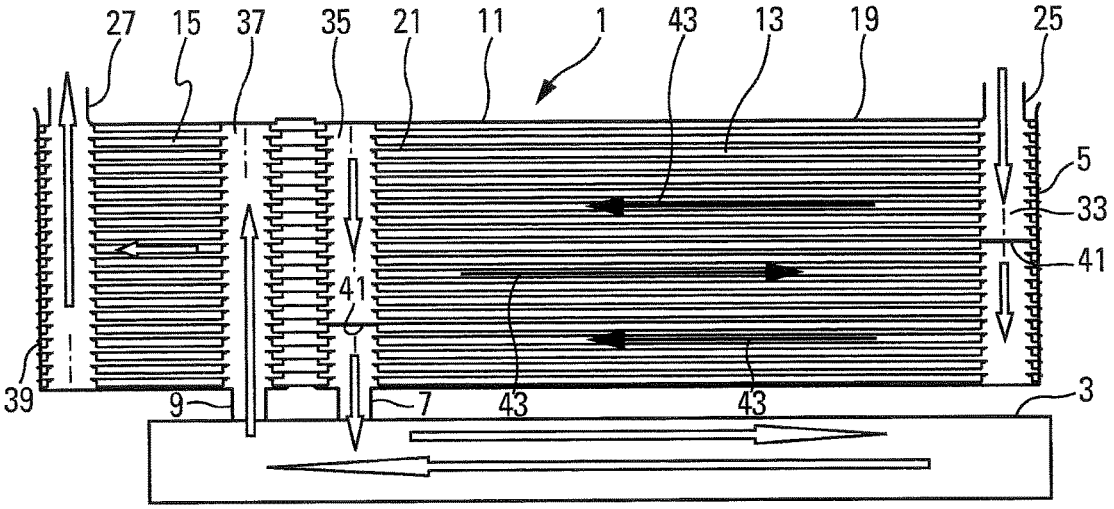
FIG. 6 is a schematic cross-section of the path of the refrigerating fluid of a condenser according to a construction variant.

Furthermore, the first heat exchange portion 13 may comprise as illustrated in FIG. 6, partitions 41 which are parallel with the plates 19 and which are arranged alternately in the inlet collector 33 of the refrigerating fluid and the outlet collector 35 of the refrigerating fluid, in order to direct the refrigerating fluid in the first heat exchange portion 13 in accordance with different successive circulation passes in accordance with the arrows 43, for example, according to passes in which the circulation of the fluid follows an opposite direction from one pass to another, such as a sinuous circulation.

Thus, the invention provides a condenser having a reserve, in particular for an air conditioning circuit of a motor vehicle, and having a simple structure and efficient operation.

The invention claimed is:

1. A condenser for an air conditioning circuit, the condenser comprising:

a housing which is configured to be connected to a single refrigerating fluid reserve positioned outside of the housing, wherein the refrigerating fluid reserve is fixed to a long outer side at a bottom of the housing by a flange comprising two cylinder shaped tubes, wherein the long outer side is longer than at least one side of the housing, the housing receiving a first heat exchange portion, corresponding to a first partial length of the long outer side, between a refrigerating fluid and a cooling liquid, the first heat exchange portion being configured to convey the refrigerating fluid to the refrigerating fluid reserve, and a second heat exchange portion, corresponding to a second partial length of the long outer side, which is configured to produce a heat exchange complement between the refrigerating fluid and the cooling liquid at an outlet of the refrigerating fluid reserve, wherein a first end of the fluid reserve is positioned externally adjacent to the first heat exchange portion of the housing, and a second end of the fluid reserve is positioned externally adjacent to the second heat exchange portion of the housing, wherein the flange is disposed across the first heat exchange portion and the second heat exchange portion.

2. The condenser as claimed in claim 1, comprising a cooling liquid circuit which is common to the first and second heat exchange portions.

3. The condenser as claimed in claim 1, comprising a different circuit for each of the first and second heat exchange portions.

4. The condenser as claimed in claim 1, wherein the housing comprises an assembly of stacked plates which define between them circulation plates of the refrigerating fluid and the cooling liquid in the first and second heat exchange portions, the assembly of stacked plates being configured to provide a circulation path of the refrigerating fluid allowing circulation in series of the refrigerating fluid in the housing, from the first heat exchange portion toward the refrigerating fluid reserve, then from the refrigerating fluid reserve into the second heat exchange portion.

5. The condenser as claimed in claim 4, wherein the assembly of stacked plates is configured to provide at least one circulation path of the cooling liquid extending in the first and second heat exchange portions.

6. The condenser as claimed in claim 4, wherein each in the assembly of stacked plates extends with continuity of material in a region of the first heat exchange portion and the second heat exchange portion.

7. The condenser as claimed in claim 4, wherein the assembly of stacked plates comprises inlet collectors and/or outlet collectors of the refrigerating fluid communicating with the circulation plates of the refrigerating fluid in a region of the first heat exchange portion and/or second heat exchange portion, and/or inlet collectors and/or outlet collectors of the cooling liquid communicating with the circulation plates of the cooling liquid.

8. The condenser as claimed in claim 7, wherein the inlet collectors and/or outlet collectors of the refrigerating fluid open at one side of the housing and the inlet collectors and/or outlet collectors of the cooling liquid open at an opposite side of the housing which is intended to be opposite the refrigerating fluid reserve.

9. The condenser as claimed in claim 7, wherein the inlet collectors of the refrigerating fluid in the first exchange portion and outlet collectors of the refrigerating fluid of the second exchange portion open at one side of the housing and the inlet collectors of the refrigerating fluid in the second exchange portion and outlet collectors of the refrigerating fluid of the first exchange portion open at an opposite side of the housing.

10. The condenser as claimed in claim 7, wherein the assembly of stacked plates extends in a rectangular parallelepipedal volume, the inlet collectors and outlet collectors of the cooling liquid and the inlet collectors of the refrigerating fluid in the first heat exchange portion and outlet collectors of the refrigerating fluid of the second heat exchange portion being orientated parallel along four edges of the housing.

11. The condenser as claimed in claim 7, wherein the first heat exchange portion comprises partitions which are parallel with the assembly of stacked plates and which are arranged alternately in the inlet collector and outlet collector of the refrigerating fluid of the first exchange portion, in order to direct the refrigerating fluid in the first heat exchange portion in accordance with a plurality of circulation passes of the refrigerating fluid.

12. The condenser as claimed in claim 4, wherein the assembly of stacked plates is configured to define a barrier to the circulation of the refrigerating fluid between the first heat exchange portion and second heat exchange portion.

13. The condenser as claimed in claim 12, wherein the assembly of stacked plates, which define the circulation plates of the refrigerating fluid are form by a metal sheet having a raised portion which defines the barrier.

14. A condenser plate of a condenser as claimed in claim 13.

15. An assembly of a condenser as claimed in claim 1; and a reserve.

16. A condenser for an air conditioning circuit, the condenser comprising:

a housing which is configured to be connected to a single refrigerating fluid reserve, the housing receiving a first heat exchange portion between a refrigerating fluid and a cooling liquid, the first heat exchange portion being configured to convey the refrigerating fluid to the refrigerating fluid reserve, and a second heat exchange portion which is configured to produce a heat exchange complement between the refrigerating fluid and the cooling liquid at an outlet of the refrigerating fluid reserve;

wherein the housing comprises an assembly of stacked plates which define between them circulation plates of the refrigerating fluid and the cooling liquid in the first and second heat exchange portions, the assembly of stacked plates being configured to provide a circulation path of the refrigerating fluid allowing circulation in series of the refrigerating fluid in the housing, from the first heat exchange portion toward the refrigerating fluid reserve, then from the refrigerating fluid reserve into the second heat exchange portion, wherein each plate in the assembly of stacked plates extends with continuity of material continuing from the first heat exchange portion through the second heat exchange portion, wherein the refrigerating fluid reserve is fixed to a long outer side at a bottom of the housing by a flange comprising two cylinder shaped tubes, and wherein a first end of the fluid reserve is positioned externally to the first heat exchange portion of the housing, and a second end of the fluid reserve is positioned externally to the second heat exchange portion of the housing, wherein the flange is disposed across the first heat exchange portion and the second heat exchange portion.

* * * * *